US009370294B2

(12) United States Patent
Osvatic et al.

(10) Patent No.: US 9,370,294 B2
(45) Date of Patent: Jun. 21, 2016

(54) STORED ENERGY GASKET-COMPRESSING LATCH WITH REDUCED ROTATIONAL FRICTION

(71) Applicants: ILLINOIS TOOL WORKS INC., Glenview, IL (US); Aileen P Hapke, Libertyville, IL (US)

(72) Inventors: Michael S. Osvatic, Waukesha, WI (US); Kenyon A. Hapke, Libertyville, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 14/425,334

(22) PCT Filed: Sep. 9, 2013

(86) PCT No.: PCT/US2013/058798
§ 371 (c)(1),
(2) Date: Mar. 3, 2015

(87) PCT Pub. No.: WO2014/039991
PCT Pub. Date: Mar. 13, 2014

(65) Prior Publication Data

US 2015/0238065 A1 Aug. 27, 2015

Related U.S. Application Data

(60) Provisional application No. 61/699,037, filed on Sep. 10, 2012.

(51) Int. Cl.
*E05C 5/02* (2006.01)
*A47L 15/42* (2006.01)
(Continued)

(52) U.S. Cl.
CPC ..... *A47L 15/4259* (2013.01); *E05C 19/02* (2013.01); *E05C 19/024* (2013.01); *E06B 5/006* (2013.01);
(Continued)

(58) Field of Classification Search
CPC ..... E05C 19/02; E05C 19/024; E05C 5/00; E05C 5/02; E05B 15/0086; Y10S 292/69
USPC ..... 292/57, 58, 63, 64, 70, 71, 78, 121, 122
See application file for complete search history.

(56) References Cited

U.S. PATENT DOCUMENTS 1,147,921 A * 7/1915 Berry ..... E05B 47/0002 292/210
2,355,895 A * 8/1944 Roberts ..... C21D 9/0006 292/2
(Continued)

FOREIGN PATENT DOCUMENTS

DE 2756366 A1 * 6/1979 ..... A47L 15/4259
EP 2471433 A1 7/2012
(Continued)

OTHER PUBLICATIONS

ISR and WO for PCT/US2013/058798 mailed Jan. 27, 2014.

*Primary Examiner* — Carlos Lugo
(74) *Attorney, Agent, or Firm* — Boyle Fredrickson, S.C.

(57) ABSTRACT

An appliance latch provides a hook that may be energized against a spring force to receive a catch element which releases the hook to pull the catch element into engagement. A toggle arm may be used to hold the hook in the energized state before receipt of the catch element to provide for a sensitive and predictable release of the spring force with rotation of the hook. The hook may be mounted on a floating pivot both to accommodate the toggle arm operation and to permit re-engagement of the catch element with the hook in the event that the hook is released from its energized state without engagement of the catch element, for example, by inertial forces.

8 Claims, 4 Drawing Sheets

(51) Int. Cl.

| | |
|---|---|
| ***E05C 19/02*** | (2006.01) |
| ***E06B 5/00*** | (2006.01) |
| *E05C 5/00* | (2006.01) |
| *E05B 15/00* | (2006.01) |

(52) U.S. Cl.
CPC ..... *E05B 15/0086* (2013.01); *E05C 5/02* (2013.01); *Y10S 292/69* (2013.01); *Y10T 292/0893* (2015.04)

(56) References Cited

U.S. PATENT DOCUMENTS

| | | | | |
|---|---|---|---|---|
| 2,833,578 | A | 5/1958 | Burke | |
| 3,201,160 | A | 8/1965 | Lewin | |
| 3,506,292 | A | 4/1970 | Hagendoorn et al. | |
| 4,163,443 | A * | 8/1979 | Peterson | E05C 5/00 126/197 |
| 4,497,513 | A | 2/1985 | Sasaki | |
| 6,290,270 | B1 | 9/2001 | Spiessl | |
| 6,349,990 | B1 * | 2/2002 | Park | B60J 7/1642 292/DIG. 5 |
| 6,913,296 | B2 * | 7/2005 | Bassi | A47L 15/4259 292/122 |
| 7,306,266 | B2 | 12/2007 | Hapke et al. | |
| 8,376,418 | B2 * | 2/2013 | Osvatic | D06F 37/42 292/198 |
| 8,733,802 | B2 * | 5/2014 | Promutico | D06F 37/28 292/113 |
| 2010/0314889 | A1 * | 12/2010 | Wang | E05C 5/00 292/97 |
| 2012/0126552 | A1 | 5/2012 | Ala | |
| 2013/0234578 | A1 | 9/2013 | Ala et al. | |

FOREIGN PATENT DOCUMENTS

| | | | | |
|---|---|---|---|---|
| IT | 1304436 | A2 * | 4/2003 | D06F 39/14 |
| WO | 2011011585 | A1 | 1/2011 | |
| WO | 2012070023 | A1 | 5/2012 | |

* cited by examiner

STORED ENERGY GASKET-COMPRESSING LATCH WITH REDUCED ROTATIONAL FRICTION

CROSS-REFERENCE TO RELATED APPLICATIONS

This application is a National Phase of International Application Number PCT/US2013/058798 filed Sep. 9, 2013 and claims the benefit of U.S. provisional application 61/699,037 filed Sep. 10, 2012 and hereby incorporated by reference.

FIELD OF THE INVENTION

The present invention relates to a latching mechanism for doors on household appliances and particularly to latching mechanisms that provide assistance in compressing a door gasket or the like.

BACKGROUND OF THE INVENTION

Appliances such as dishwashers and front-loading washing machines may have an access door with a gasket that must be compressed to seal water within a washing chamber. Small area, highly compliant gaskets may be sealed by pressure from the user during the closing of the door. The gasket may then be held in a compressed state by a latch mechanism.

Gaskets which require more force may be compressed by a latch mechanism having a lever operated by the user to engage a catch and draw the catch inward with a lever advantage to compress the gasket and hold the door shut.

A closing lever may be avoided in latch mechanisms that provide a bi-stable spring mechanism. During initial stages of closing of the door, closing force on the door is used to energize a spring. When the door closes past a balance point, the spring releases its energy in a manner to pull the door fully closed. An example of an over-center spring mechanism is described in U.S. Pat. No. 4,497,513 to Sasaki.

A variation on the bi-stable spring mechanism energizes the spring as the door is opened and holds that energy until the door is closed again. A balance point must still be crossed, and therefore a slight compression of the spring is required when the door is closed to release the energy. A latch of this kind is disclosed in U.S. Pat. No. 2,833,578 to Burke.

U.S. Pat. No. 6,290,270 to Spiessl shows a variation on Burke in which the latch spring is energized when the door is opened and held in the energized state by the rotation of a hook cam. When the door is closed, the hook cam is rotated by a catch element to release the energized spring by moving a rim of the hook cam past a stop. This design reduces the force required to close the door by eliminating the need to compress a bi-stable spring past the balance point during door closure. In this design, the hook cam must be held on a lever, and the energized spring moves the lever and hook cam.

U.S. Pat. No. 7,306,266 to Hapke, assigned to the same assignee as the present invention and hereby incorporated by reference, provides a latch that supports a rotating hook cam on a linear carriage rather than a lever, reducing the bending forces and permitting the carriage element to be manufactured of thermoplastic material.

In these latter two designs, the rotating hook cam is held in its energetic state, before receipt of the catch element and closure of the door, by a stop abutting an outer surface of the hook cam. When the hook cam rotates with engagement of the catch element, the hook cam rotates so that a reduced diameter portion of the hook cam aligns with the stop allowing movement of the hook cam in retraction to compress the door gasket.

The high forces between the hook cam and this stop can generate significant friction and accordingly it is known to use a rotating wheel for the stop to reduce sliding friction between the stop and hook cam. However reducing this friction increases the chance that the hook cam will accidentally shift in position independent of engagement of the catch element preventing proper operation in the future.

SUMMARY OF THE INVENTION

The present invention provides a hook that is held in its energetic state by a pivoting lever that may lock in an over-center position rather than by a stop operating on a cam surface of the hook. The use of the lever element, rather than sliding contact between the cam surface and a stop, greatly reduces the friction that must be overcome to release the hook yet ensures a well-defined resistance to accidental dislodgment of the energized hook defined by the amount of over-center travel of the pivoting lever.

The risk that a low activation force will prematurely trigger release of the hook is accommodated by using a floating pivot that allows the catch element to push the hook aside to engage the hook in such circumstances to reset the latch.

Specifically then, the present invention provides an appliance latch for receiving a catch element along an axis in a receiving direction. The latch includes a latch frame attachable to a portion of the appliance and a floating pivot movable independently with respect to the latch frame along the axis and across the axis. A hook is supported to rotate about the floating pivot to capture a portion of the catch element in a capture position when the catch element enters a hook opening and to release the catch element in a release position when the catch element exits the hook opening. One or more springs urge the floating pivot in the receiving direction along the axis to move the hook.

It is thus a feature of at least one embodiment of the invention to provide a mounting for the rotating hook that facilitates use of a low friction blocking element holding the hook in energized state and that accommodates the risk of accidental hook activation by allowing a resetting in which the catch element is reengaged with the hook after the hook is in the capture position.

The one or more springs may also urge the floating pivot across the axis.

It is thus a feature of at least one embodiment of the invention to provide spring-biased re-engagement of the hook and catch element during a reset operation.

A single spring may urge the floating pivot in part along the axis and in part across the axis.

It is thus a feature of at least one embodiment of the invention to reduce the number of springs required.

The floating pivot may include a sliding element sliding across the axis with respect to the latch frame and a swing arm element pivotally attached to a sliding element to move the hook along the axis.

It is thus a feature of at least one embodiment of the invention to implement at least one direction of "float" through the use of a simple swing arm structure.

The swing arm may be pivotally attached to the latch frame by a pivot axle fitting within a slot extending across the axis and fixed with respect to the frame axis and a single spring may communicate between the latch frame and the swing arm to urge the hook along the axis in the receiving direction and across the axis.

It is thus a feature of at least one embodiment of the invention to implement a floating pivot by a slotted pivot axle support.

Alternatively, the swing arm may be pivotally attached to a sled sliding along a surface of the latch frame wherein a first spring communicates between the swing arm and the sled to urge the hook along the axis and wherein a second spring communicates between the latch frame and the sled to move the sled across the axis.

The appliance latch may further include a toggle arm extending between the hook and the latch frame and pivotally attached to each of the hook and latch frame to brace the hook against movement in the receiving direction when the hook is in the release position and to release the hook for movement in the receiving direction with rotation of the hook from the release position to the capture position.

It is thus a feature of at least one embodiment of the invention to eliminate a high friction stop holding the hook in an energized position.

The pivotal attachment between the toggle arm and the hook may cross a line between the pivotal attachment between the toggle arm and the frame and the floating pivot point when the hook moves between the release position and the capture position.

It is thus a feature of at least one embodiment of the invention to provide for a bi-stable element that promotes the hook being positioned stably in the capture position or release position.

The appliance latch may further include an electrical switch indicating that the catch element has engaged the latch.

It is thus a feature of at least one embodiment of the invention to provide a latch that may indicate proper closure of the door for the purpose of electrical interlocks on the appliance.

The electrical switch may provide an operator triggered by the catch element independent of a position of the hook.

It is thus a feature of at least one embodiment of the invention to provide a switching system that is not triggered by accidental release of the hook when the hook does not engage the catch element.

The hook may provide a wedge surface extending diagonally to the axis when the hook is in the capture position to contact a catch element not engaged by the hook and, moving in the receiving direction, push the hook and floating pivot to move across the axis to allow the catch element to enter the hook opening when the hook is not in the receiving position.

It is thus a feature of at least one embodiment of the invention to allow door closure and latch resetting in the event of accidental triggering, for example, caused by shocks during shipping or installation or the like.

Other features and advantages of the invention will become apparent to those skilled in the art upon review of the following detailed description, claims and drawings in which like numerals are used to designate like features.

Figure 1:
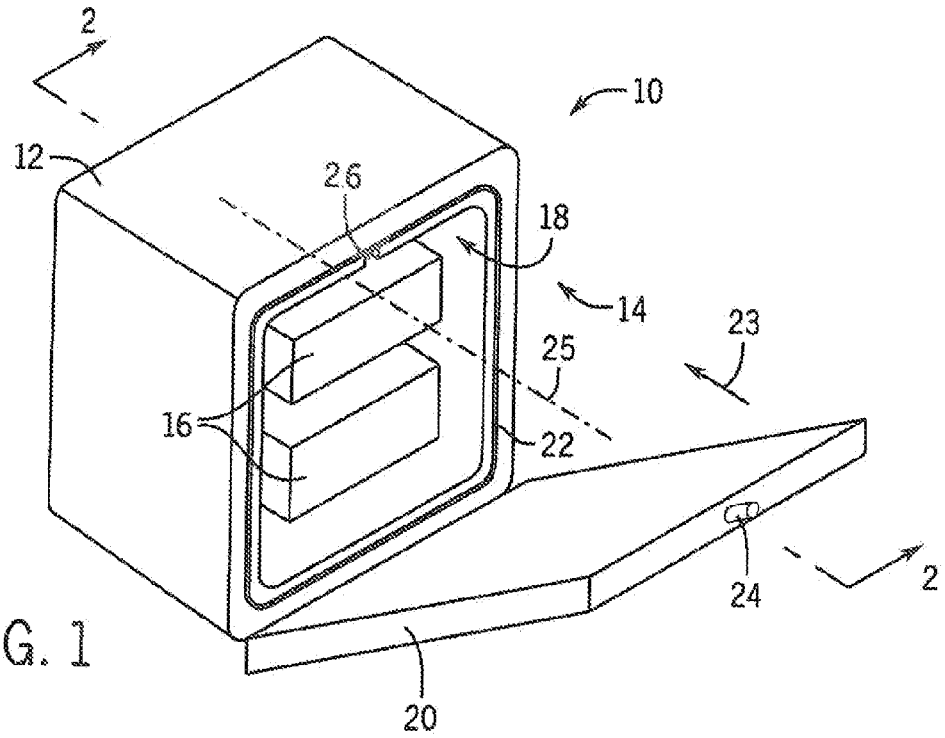
FIG. 1 is a simplified perspective view of a dishwasher that incorporates the latch of the present invention, showing a door having an upwardly extending catch element as may be received by a latch mechanism on a front edge of the dishwasher cabinet.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, an appliance 10 such as a dishwasher or washing machine may provide for a housing 12 having a front opening 14 exposing one or more dish racks 16 for holding dishes or the like (in the case of a dishwasher) for washing within a housing volume 18. A door 20 may be hingeably attached to the front of the housing 12 to seal thereagainst by compressing intervening peripheral gasket 22 encircling the front opening 14.

The door 20 may have a catch element 24, for example, a pin, extending upward from an upper edge thereof which may be received by a latch mechanism 26 along a horizontal axis 25 in a receiving direction 23 (parallel to horizontal axis 25). Once so received, the catch element 24 is retained within the latch mechanism 26 to hold the door 20 in a closed position during the washing cycle with a sealing compression of the gasket 22.

Figure 2:
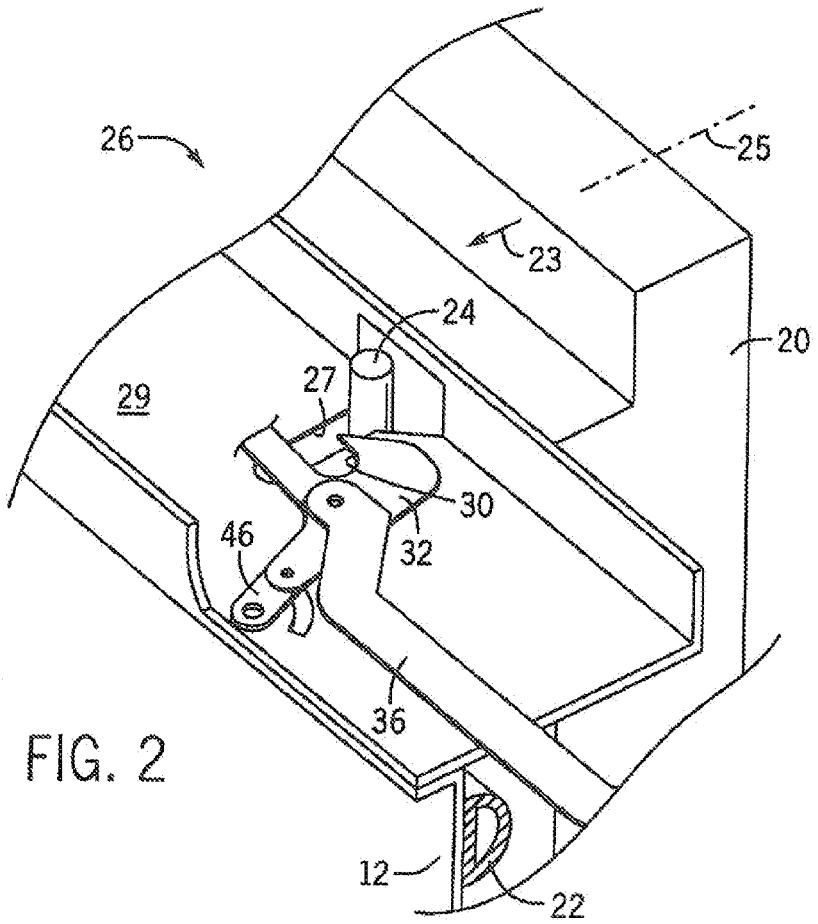
FIG. 2 is a perspective cutaway of the appliance door and appliance housing showing positioning of a hook and toggle arm of the latch mechanism for receipt of the catch element.
Figure 3:
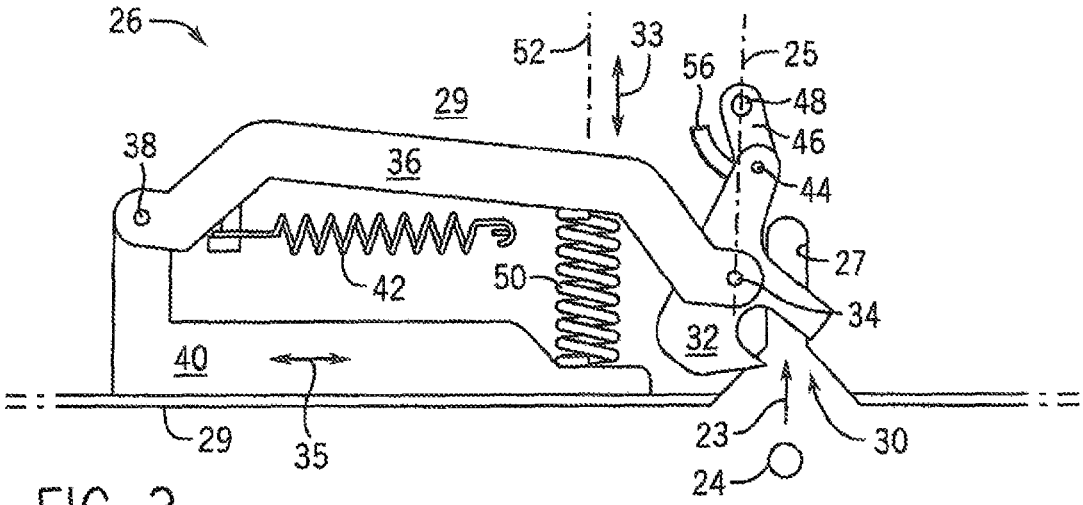
FIG. 3 is a top plan view of a latch mechanism with the hook attached to a floating pivot in the "capture position" as held by the toggle arm prior to receiving the catch element, the floating pivot point being provided by a sliding sled element and swing arm.

Referring now to FIGS. 2 and 3, within the latch mechanism 26 the catch element 24 may pass into a downwardly and rearwardly opening slot 27 in a latch frame 29 to be received within a hook opening 30 of a rotatable hook 32. The hook 32 may pivot about a floating pivot 34 at one end of a swing arm 36 extending generally perpendicular to axis 25. This pivoting of the swing arm 36 provides a first direction 33 of motion of the floating pivot 34 being generally parallel to the receiving direction 23 and axis 25.

The other end of the swing arm 36 may attach to a pivot point 38 supported on a sled 40 slidable perpendicularly to axis 25 against a surface of the latch frame 29. The sled 40 provides a second direction 35 of motion of floating pivot 34 generally across or perpendicular to the axis 25. The sled 40 is biased in the direction of the hook 32 by a helical extension spring 42 connected between the latch frame 29 and a portion of the sled 40.

The two generally perpendicular directions 33 and 35 of the floating pivot 34 are independent before the floating pivot 34 is attached to the hook 32 and constrained thereby, meaning that motion in one direction 33 does not uniquely determine the position along direction 35.

The hook 32 may also be attached by means of pivot 44 near a periphery of the hook 32 away from the catch element 24 to one end of a toggle arm 46. The toggle arm 46, in turn, attaches via a pivot 48 to the latch frame 29. As shown in FIG. 3, when the hook 32 is in a fully energized "receiving position" with floating pivot 34 fully toward the approaching catch element 24 on swing arm 36, the swing arm 36 compresses a compression spring 50 operating to bias swing arm 36 and hook 32 away from the approaching catch element 24 along the receiving direction 23. The compression spring 50 may be positioned between a portion of the sled 40 and the swing arm 36 so as to slide with motion of the sled 40. The energy in the compression spring 50 provides sufficient force for the compression of the gasket 22 into a state of sealing. Generally, the force exerted by compression spring 50 on floating pivot 34 is along line of action 52 roughly parallel with axis 25.

Movement of the swing arm 36 and the hook 32 under the influence of compression spring 50 in this energized receiving position is prevented by a blocking action of the toggle arm 46 which is in an over-center position in which pivot 44 is to the right of a line of action 52 between pivot 48 and floating pivot 34. This over-center position tends to rotate the toggle arm 46 in a counterclockwise direction as depicted but counterclockwise rotation is prevented by a range-limiting track (for example, a slot receiving a downwardly projecting tooth on the toggle arm 46) engaging the toggle arm 46, or other blocking element.

Figure 4:
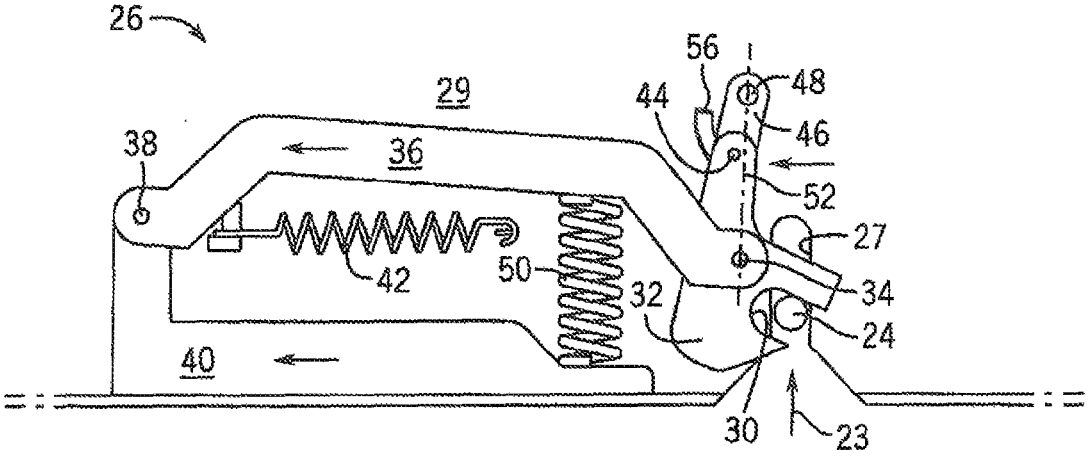
FIG. 4 is a figure similar to that of FIG. 3 showing an initial engagement of the hook and the catch element such as moves the toggle mechanism to an over-center position.

Referring now to FIG. 4, as the catch element 24 engages the hook opening 30 of the hook 32 it causes counterclockwise rotation of the hook 32 about the floating pivot 34. This rotation in turn causes the toggle arm 46 to move in a clockwise direction about pivot 48 so that pivot 44 moves leftward across the line of action 52. The over-center position (to the right of the line of action 52) of the toggle arm 46, at a point where its rotation is stopped, and the spring force of spring 50, together determine exactly how much force must be exerted on the hook 32 by the catch element 24 to move the toggle arm to the left of the line of action 52. By tailoring this force, accidental displacement of the hook 32 is reduced and resistance to accidental displacement of the hook 32 does not rely on the varying influence of friction.

Figure 5:
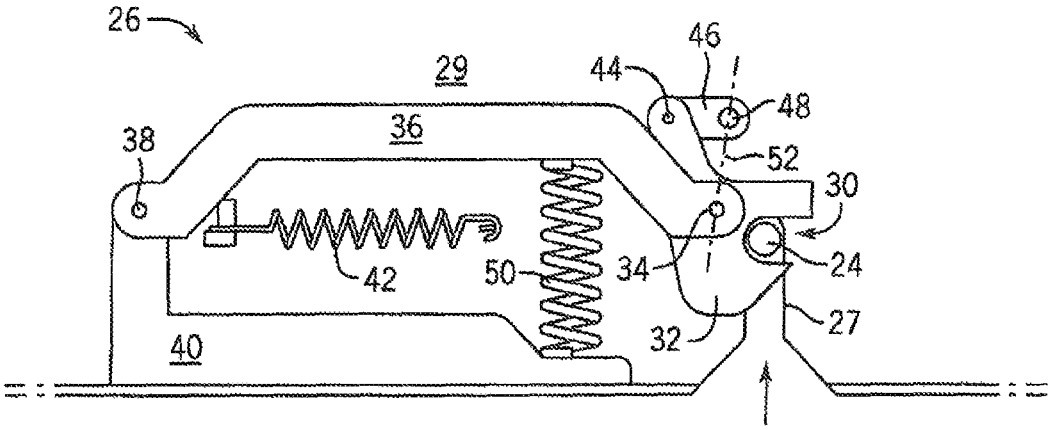
FIG. 5 is a figure similar to that of FIGS. 3 and 4 showing the hook in the capture position.

Referring now to FIG. 5, when the toggle arm 46 moves clockwise so that the pivot 44 crosses the left of the line of action 52, the track 56 no longer constrains rotation of the toggle arm 46. Accordingly, the toggle arm 46 may move fully 90 degrees in a clockwise direction allowing full retraction of the hook 32 to a capture position as driven by the spring 50 to pull the catch element 24 inward releasing the force of spring 50 to compress the gasket 22.

It will be appreciated that all forces affecting motion of the hook 32 are concentrated on relatively small contact areas of pivots 44, 34 and 48 reducing the effective frictional resistance by the mechanical advantage of the levers that connect to the pivots. This is in contrast to the more substantial sliding friction between a hook cam and a stop in prior art designs. Generally spring 50 may be recompressed and the hook 32 returned to its receiving position by pulling outward on the door to withdraw the catch element 24 from the slot 27. Generally, energy used in opening the door of the appliance is recycled to help close the door of the appliance through the agency of the spring 50

Figure 6:
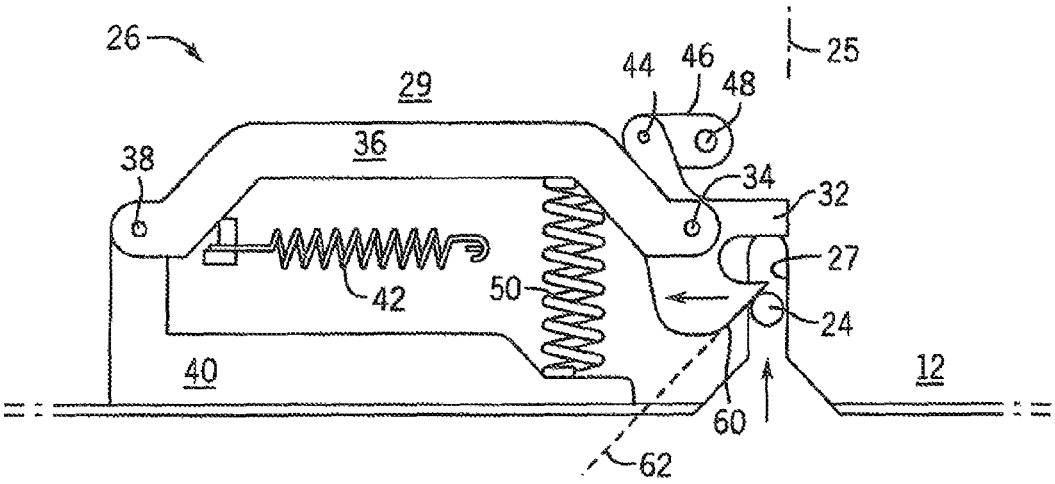
FIG. 6 is a figure similar to that of FIGS. 3-5 showing the hook in the capture position prior to engagement with the catch element, this position caused by inadvertent activation of the hook through a shock or the like and showing a wedge surface of the hook pushing the hook out of way to allow engagement of the hook with the catch element, the hook moving as supported on the floating pivot.

Referring now to FIG. 6, it will be appreciated that if the hook 32 is inadvertently released to its de-energized state (capture state) while not engaging the catch element 24, for example, as may be caused by shipping, tampering or installation shocks, the catch element 24 may nevertheless be pushed along axis 25 past a front lip 60 of the hook 32 to be then received by opening 30 in the hook 32. In this regard, the front lip 60 has a slope 62 that is diagonal to the axis 25 (for example, at 45 degrees) to cause a leftward motion of the hook 32 when the catch element 24 is pressed against the front lip 60. This movement of the hook 32 under pressure from the catch element 24 against front lip 60 is accommodated by the floating pivot 34 and results in movement of the sled 40 leftward against the influence of the helical spring 42. Movement of the hook 32 allows the catch element 24 to be reengaged within the hook opening 30 to essentially reset the latch mechanism 26. This leftward motion of the hook 32 does not require movement of the toggle arm 46 which remains in the position normally associated with the capture position of the hook 32.

Figure 7:
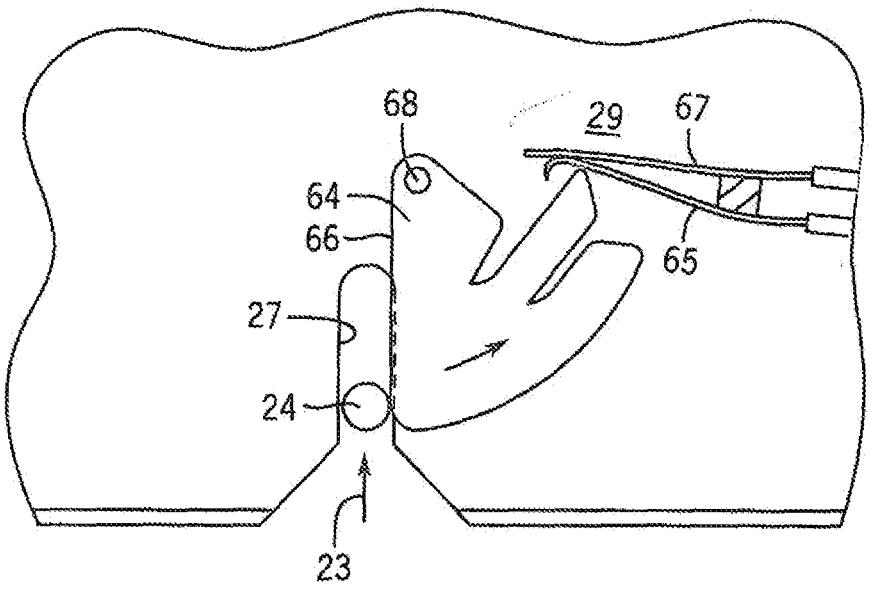
FIG. 7 is a fragmentary figure similar to that of FIGS. 3-6 with the hook, toggle arm and floating pivot removed for clarity showing a switch having an operator activated by movement of the catch element.

Referring now to FIG. 7, the catch element 24 moving within the slot 27 may further move a switch operator 64, for example, having a curved cam surface 66 extending over the slot 27 and causing the switch operator 64 to move counterclockwise about a pivot 68 attached to the frame 29 when the catch element 24 moves in receiving direction 23 into the slot 27. The shape of the cam surface 66 is such as to promote sufficient rotation of the operator 64 to close a leaf spring contact 65 against a second contact 67 when the catch element 24 is fully received within the slot 27 (in a manner that would typically allow it to be fully engaged by the hook 32 as shown, for example, in FIG. 6 in the capture position). The leaf spring contact 65 and second contact 67 together form an electrical switch. The switch formed by contact 65 and 67 may provide a signal to an appliance controller preventing operation of the appliance when the door 20 is not fully closed. The leaf spring contact 65 otherwise normally biases the operator 64 in a clockwise direction to partly occlude the slot 27.

Figure 8:
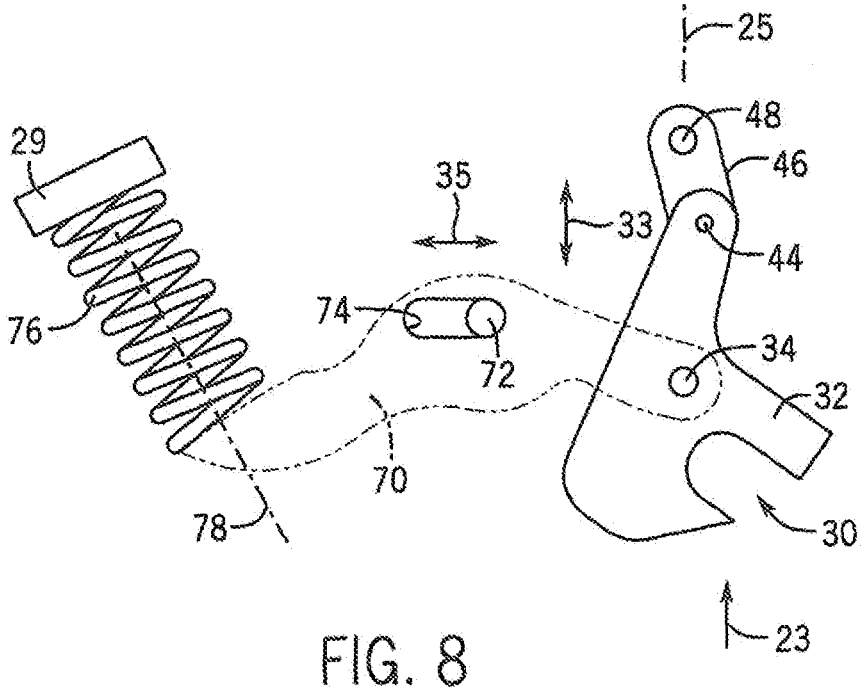
FIG. 8 is a top plan view of an alternative floating pivot employing a single spring and swing arm mounted to pivot in a slot.

Referring now to FIG. 8, it will be appreciated that the floating pivot 34 may be implemented alternatively as a pivot on one end of a lever 70, the lever in turn pivoting about a fulcrum pin 72 fitting within a slot 74 in the latch frame 29. The slot 74 extends generally perpendicularly to axis 25 and allows the lever 70 and hence the floating pivot 34 to move in the direction 35. Pivoting action of the lever 70 about the pin 72 in the frame 29 provides motion of the floating pivot 34 in the direction 33 discussed above.

A single compression spring 76 may have a line of force 78 generally diagonal to axis 25 to provide a component of bias along the direction 35 (as otherwise provided by spring 42 as shown in FIG. 6) and a component of bias in the receiving direction 23 (otherwise provided by spring 50 as shown in FIG. 6) where the degree of bias may be readily controlled by changing the line of force 78.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. An appliance latch assembly for receiving a catch element along an axis in a receiving direction, the latch comprising:

a latch frame attachable to a portion of an appliance;

a floating pivot movable independently with respect to the latch frame along the axis and across the axis;

a hook supported to rotate about the floating pivot to capture a portion of the catch element in a capture position when the catch element enters a hook opening and to release the catch element in a release position when the catch element exits the hook opening wherein the floating pivot moves along the axis both when the hook is in the release position before the catch element enters the hook opening and when hook is in the capture position before the catch element exits the hook opening and wherein the floating pivot moves across the axis when the hook is in the capture position before the catch elements enters the hook opening; and at a spring adapted to urge the floating pivot in the receiving direction along the axis;

further including a toggle arm extending between the hook and the latch frame and pivotally attached to each of the hook and latch frame to brace the hook against movement in the receiving direction when the hook is in the release position and to release the hook for movement in the receiving direction with rotation of the hook from the release position to the capture position;

further including a swing arm pivotally attached to the latch frame through an interengaging slot and pin so that the swing atm both pivots and is movable across the axis with respect to the frame, the swing arm being pivotally attached to the hook, and wherein the spring communicates between the latch frame and the swing arm to urge the hook along at least one of the axis in the receiving direction and across the axis.

2. The appliance latch assembly of claim 1 wherein the spring urges the swing at across the axis.

3. The appliance latch assembly of claim 1 wherein the spring is a single spring urging the swing arm across the axis and urging the swing arm to pivot so that the hook moves along the axis in the receiving direction.

4. The appliance latch assembly of claim 1 further including an electrical switch indicating that the catch element has engaged the latch.

5. The appliance latch assembly of claim 4 wherein the electrical switch provides an operator triggered by the catch element independent of a position of the hook.

6. The appliance latch assembly of claim 1 wherein the hook provides a wedge surface extending diagonally to the axis when the hook is in the capture position to contact a catch element not engaged by the hook and moving in the receiving direction to push the hook and floating pivot to move across the axis to allow the catch element to enter the hook opening when the hook is not in the receiving position.

7. An appliance latch assembly for receiving a catch element along an axis in a receiving direction, the latch comprising:

a latch frame attachable to a portion of an appliance;

a floating pivot movable independently with respect to the latch frame along the axis and across the axis;

a hook supported to rotate about the floating pivot to capture a portion of the catch element in a capture position when the catch element enters a hook opening and to release the catch element in a release position when the catch element exits the hook opening wherein the floating pivot moves along the axis both when the hook is in the release position before the catch element enters the hook opening and when hook is in the capture position before the catch element exits the hook opening and wherein the floating pivot moves across the axis when the hook is in the capture position before the catch elements enters the hook opening; and a first spring adapted to urge the floating pivot in the receiving direction along the axis and a second spring adapted to urge the floating pivot point across the axis;

further including a toggle arm extending between the hook and the latch frame and pivotally attached to each of the hook and latch frame to brace the hook against movement in the receiving direction when the hook is in the release position and to release the hook for movement in the receiving direction with rotation of the hook from the release position to the capture position further including a sliding element sliding across the axis with respect to the latch frame and a swing arm element pivotally attached to a sliding element to move the hook along the axis;

wherein the sliding element includes a sled and the swing arm is pivotally attached to the sled sliding along a surface of the latch frame wherein the first spring communicates between the swing arm and the sled to urge the hook along the axis and wherein the second spring communicates between the latch frame and the sled to move the sled across the axis.

8. The appliance latch assembly of claim 7 wherein the pivotal attachment between the toggle arm and the hook crosses a line between a pivotal attachment between the toggle arm and the frame and the floating pivot point when the hook moves between the release position and the capture position.

* * * * *